US011655651B2

(12) United States Patent
Aspinwall et al.

(10) Patent No.: US 11,655,651 B2
(45) Date of Patent: May 23, 2023

(54) INSTALLING A WIRE FENCE TO A POST

(71) Applicant: NV BEKAERT SA, Zwevegem (BE)

(72) Inventors: David Aspinwall, Marietta, GA (US); Curran Lehr, Smyrna, GA (US)

(73) Assignee: NV BEKAERT SA, Zwevegem (BE)

( * ) Notice: Subject to any disclaimer, the term of this patent is extended or adjusted under 35 U.S.C. 154(b) by 198 days.

(21) Appl. No.: 17/104,292

(22) Filed: Nov. 25, 2020

(65) Prior Publication Data

US 2021/0156167 A1 May 27, 2021

Related U.S. Application Data

(60) Provisional application No. 62/940,972, filed on Nov. 27, 2019.

(51) Int. Cl.
*E04H 17/12* (2006.01)
*E04H 17/04* (2006.01)
*E04H 17/02* (2006.01)

(52) U.S. Cl.
CPC ..... *E04H 17/12* (2013.01); *E04H 17/04* (2013.01); *E04H 17/127* (2021.01); *E04H 17/131* (2021.01)

(58) Field of Classification Search
CPC ..... E04H 17/02; E04H 17/04; E04H 17/05; E04H 17/06; E04H 17/10; E04H 17/12; E04H 17/124; E04H 17/127; E04H 17/131
USPC ..... 256/32, 48, 52, 54, 56
See application file for complete search history.

(56) References Cited

U.S. PATENT DOCUMENTS 454,611 A * 6/1891 Crane ..... E04H 17/10 256/52
616,970 A * 1/1899 Quinn ..... E04H 17/04 256/5
714,178 A * 11/1902 Harris ..... E04H 17/04 256/45
819,637 A * 5/1906 Diescher ..... E04H 17/10 256/57
1,088,942 A * 3/1914 Swank ..... E04H 17/10 256/43
1,378,489 A 5/1921 Sommer
1,454,649 A * 5/1923 Murton ..... E04H 17/10 256/54

(Continued)

FOREIGN PATENT DOCUMENTS

FR 2476191 A1 * 8/1981 ..... E04H 17/12
WO WO-89/02994 A1 4/1989

*Primary Examiner* — Josh Skroupa
(74) *Attorney, Agent, or Firm* — Foley & Lardner LLP

(57) ABSTRACT

A method to install a wire fence includes providing horizontal and vertical wires and connecting them to form a wire fence. The method further includes providing a post to form a termination of the wire fence, providing one hole for each horizontal wire in the post, and driving the post into the ground. The method further includes inserting the horizontal wire ends through the holes in the post, attaching wire tensioning devices to some of the horizontal wire ends, and stretching the horizontal wires by the tensioning devices. The method further includes keeping the tensioning devices on the horizontal wire ends. The tensioning devices keep the horizontal wires attached to the pole, and placing a cover plate to the post to cover the tensioning devices and the horizontal wire ends.

8 Claims, 2 Drawing Sheets

(56) References Cited

U.S. PATENT DOCUMENTS

2008/0029746 A1 2/2008 Creed et al.
2015/0104261 A1* 4/2015 Aspinwall ..... E21D 11/152
405/259.1

* cited by examiner

INSTALLING A WIRE FENCE TO A POST

TECHNICAL FIELD

The invention relates to a method of installing a wire fence to a post, particular for residential purposes.

BACKGROUND ART

Wire fences like chain link fences are popular in the market. Chain link fences are relatively easy to install but they require an upper bar upon which the chain link fence is hung. This upper bar makes the whole more expensive.

In wire fences with horizontal wires, the stretching or tensioning very often forms a problem. In an attempt to alleviate this problem some wire fences have horizontal wires with crimps or undulations. In spite of this, installing a wire fence where all horizontal wires are equally stretched and where the installed wire fence exhibits a flat surface often requires experienced and professional skills.

Another problem is the fixation of the posts. A hole must be dug in the ground and the post must be anchored in a cementitious matrix while being positioned perfectly vertically. Here again a novice fence builder experiences difficulties to get this done in the right way.

DISCLOSURE OF INVENTION

It is a general object of the invention to avoid or at least to mitigate the problems of the prior art.

It is a particular object of the invention to provide a method of installing a wire fence that is straightforward, quick and simple.

It is another object of the invention to provide a method of installing a wire fence that can be applied by a novice fence builder.

According to a general aspect of the invention, there is provided a method of installing a wire fence to a post. The wire fence comprises horizontal and vertical wires. The horizontal wires have horizontal wire ends. The installation method comprises the following steps:

a) providing horizontal wires;

b) providing vertical wires;

c) connecting the vertical wires to the horizontal wires to form a wire fence;

d) providing a post to form a termination of the wire fence;

e) providing holes in the post, one hole for each horizontal wire;

f) driving the post into the ground;

g) providing sufficient length at the horizontal wire ends to allow termination and tensioning of the horizontal wires;

h) inserting the horizontal wire ends through the holes in the post;

i) attaching wire tensioning devices to some of the horizontal wire ends, one wire tensioning device per horizontal wire end;

j) stretching the horizontal wires by means of the tensioning devices;

k) keeping the tensioning devices on the horizontal wire ends, whereby the tensioning devices keep the horizontal wires attached to the pole;

l) placing a cover plate to the post to cover the tensioning devices and the horizontal wire ends.

The horizontal wires and the vertical wires may be metal wires and are preferably steel wires. The horizontal wires may have a higher breaking load than the vertical wires in order to allow stretching, for example the horizontal wires may be somewhat thicker than the vertical wires or may have an equal diameter but a higher tensile strength.

In step i) wire tensioning devices may be attached to all of the horizontal wire ends.

The vertical wires may be connected to the horizontal wires in step c) in any way, for example by welding or by twisting or wrapping part of the vertical wires around the horizontal wires.

Preferably, the vertical wires are connected to the horizontal wires by means of an additional piece of wire that forms a knot at the crossing points between the horizontal wires and the vertical wires. The wire fence created in this way is called a knotted wire fence.

Most preferably, the piece of wire that is forming the knot is made of a metal wire or steel wire that is more ductile than the horizontal and vertical wires in order to allow the bending needed for knot formation.

Sufficient length in step g) is created by removing one or more vertical wires. This can be more easily done in case of a knotted fence in comparison with fences where horizontal wires are welded to vertical wires.

In a preferable embodiment of installing the wire mesh and, more particularly, the post, a bottom plate is attached to the post. The bottom plate divides the post in an upper part, intended to stay above the ground level, and a lower part, intended to be driven into the ground.

Most preferably, the bottom plate is reinforced.

Step f) of driving the post into the ground can be done by exercising force on the bottom plate. The use of the bottom plate as drive plate is much safer and easier than to try and hit the top of the post.

BRIEF DESCRIPTION OF FIGURES IN THE DRAWINGS

MODE(S) FOR CARRYING OUT THE INVENTION

Figure 1:
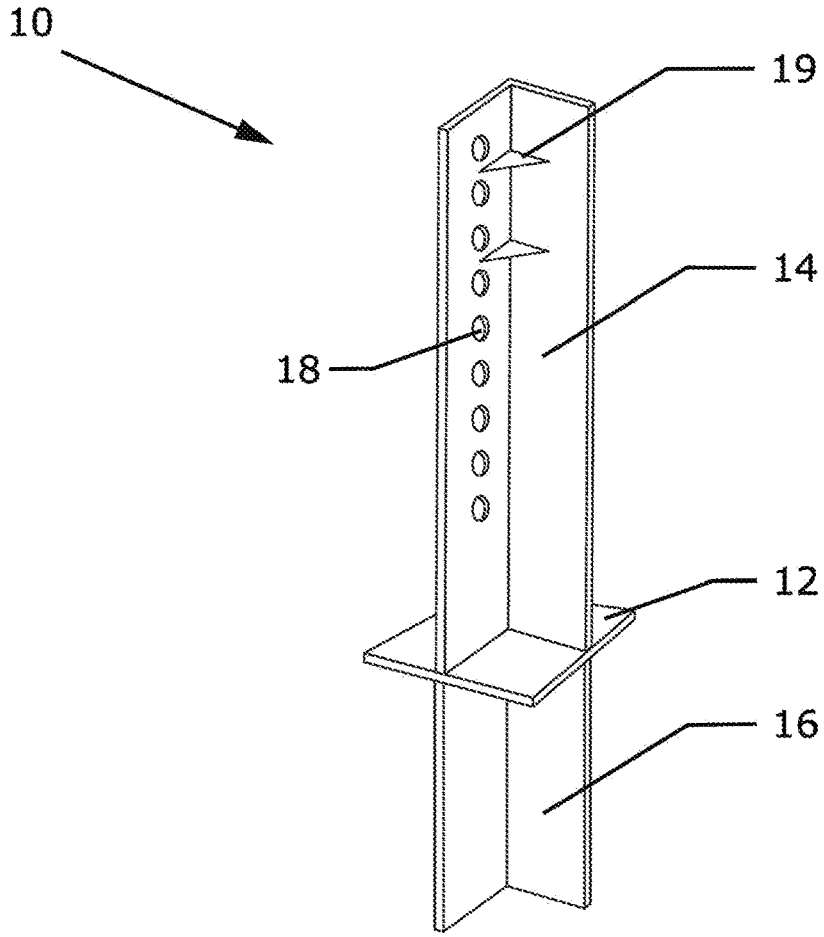
FIG. 1 is a side view of post.
Figure 2:
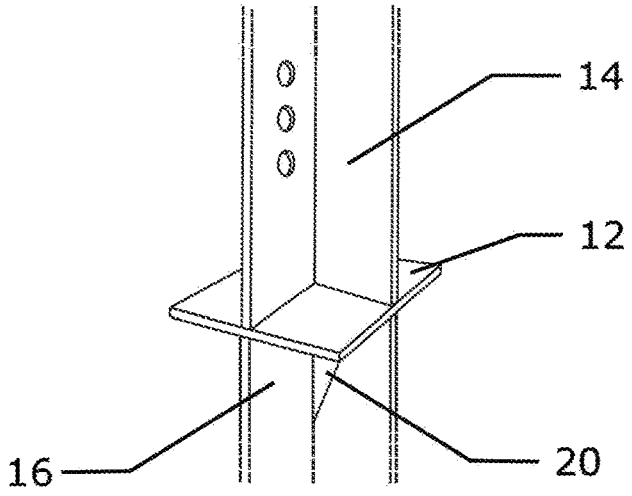
FIG. 2 is another side view of part of the same post.

FIG. 1 is a side view of a post 10 and FIG. 2 is a view from another side of part of the same post 10 to be used in the installation method of the invention.

Post 10 is made of an aluminium or steel plate material and has an L-shaped cross-section. Post 10 can be made out one planar plate that has been bent or out of two planar plates that are welded together.

A bottom plate 12, which can also be made of aluminium or steel, divides the plate 12 over its length in two parts: One part is the upper part 14 intended to stay visible and above the ground and the other part is the lower part 16 intended to be driven into the ground. The bottom plate 12 can be welded to the elongated L-shaped body.

Holes 18 are provided in the upper part 14 of the post, at least one hole 18 per horizontal wire. The distance between two successive holes 18 matching substantially the distance between two neighbouring horizontal wires in the wire fence.

In a preferable embodiment of the invention, the holes may be offset with respect to each other in order to avoid interference between two neighbouring wire tensioners.

Triangular brace plates 19 can be fixed, e.g. welded, to the post 10 to further reinforce the post 10.

As mentioned, post 10 can be driven into the ground without making use of a cementitious matrix material as mortar or cement. A vertical downward force is exercized on the bottom plate 12. In order to receive these impact forces the bottom plate 12 is preferably reinforced by means of a reinforcing brace 20 which brings additional support to the bottom plate 12.

Figure 3:
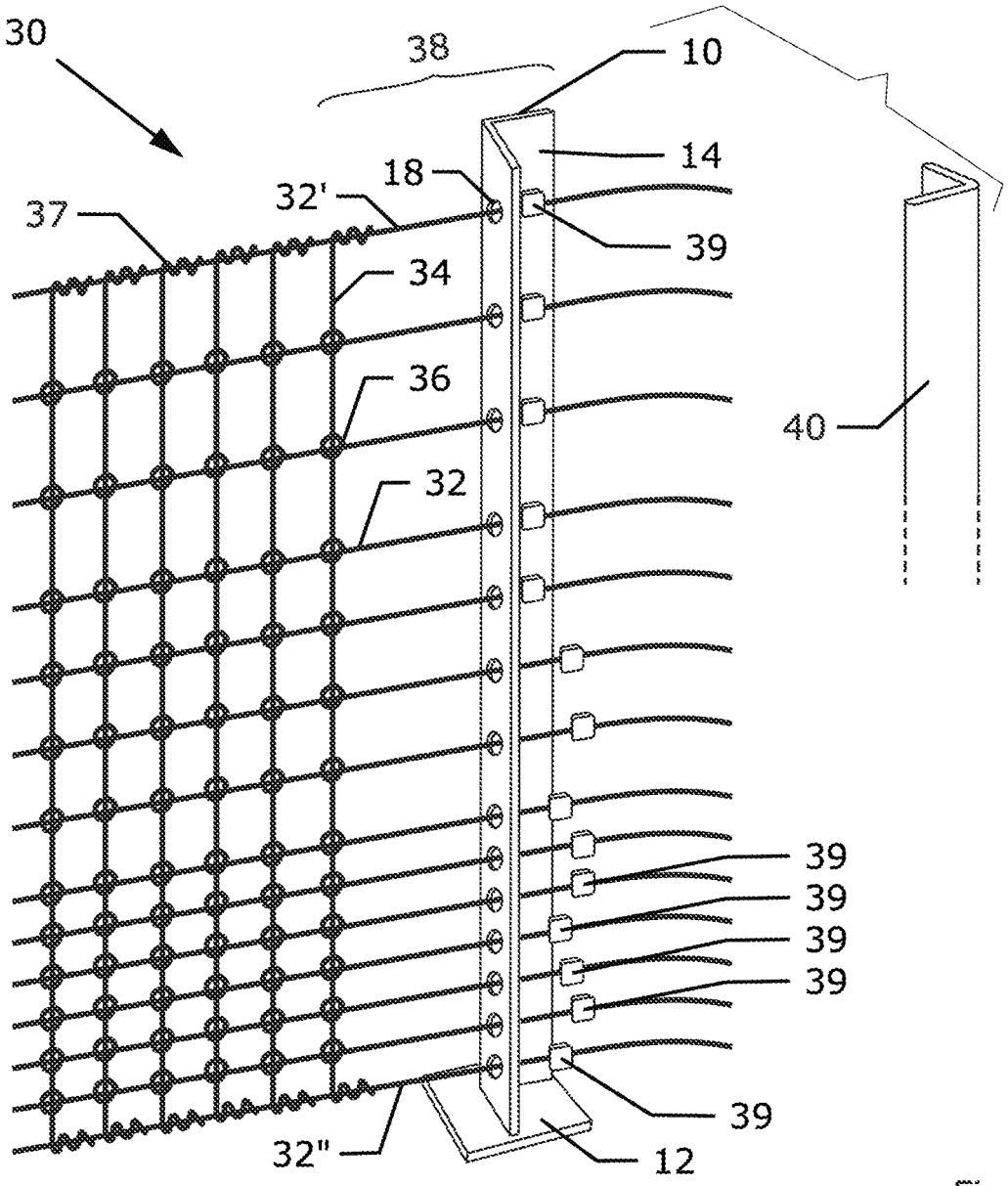
FIG. 3 illustrates a wire fence when being installed to the post

FIG. 3 illustrates a wire fence 30 when being installed to a post 10. The wire fence 30 has horizontal wires 32 (including an upper horizontal wire 32' and a bottom horizontal wire 32") that are connected to vertical wires 34. Except for the upper horizontal wire 32' and the bottom horizontal wire 32", the horizontal wires 32 are connected to the vertical wires 34 by means of a knot 36. The vertical wires 34 are connected to the upper horizontal wire 32' and the bottom horizontal wire 32" by wrapping, i.e. the ends of the vertical wires 34 are wrapped a number of times around the upper horizontal wire 32' and the bottom horizontal wire 32".

The horizontal wires 32, 32', 32", the vertical wires 34 and the pieces of wire making the knot 36 are preferably metal wires, most preferably steel wires.

The steel wires may be low carbon steel wires with a carbon content ranging between 0.04 weight percent and 0.40 weight percent. An example of a typical low carbon steel composition is a carbon content of 0.06 wt %, a silicon content of 0.166 wt %, a chromium content of 0.042 wt %, a copper content of 0.173 wt %, a manganese content of 0.382 wt %, a molybdenum content of 0.013 wt %, a nitrogen content of 0.006 wt %, a nickel content of 0.077 wt %, a phosphorus content of 0.007 wt %, a sulphur content of 0.013 wt %, the remainder being iron and unavoidable impurities.

The steel wires may also be medium carbon steel wires. Medium carbon steel wires may have a steel composition with a carbon content ranging from 0.40 wt % to 0.55 wt %, a manganese content ranging from 0.25 wt % to 0.65 wt %, a sulphur content below 0.05 wt % and a phosphorus content below 0.04 wt %.

The steel wires may be covered with a corrosion resistant coating such as a polymer coating or a metal coating or a combination of both.

The polymer may be PVC or polyester. The polymer coating is preferably applied by means of an extrusion process.

The metal coating is preferably a zinc coating or a zinc alloy coating.

A zinc alloy coating may be a zinc aluminum coating that has an aluminum content ranging from 2 percent by weight to 12 percent by weight, e.g. ranging from 3% to 11%.

A preferable composition lies around the eutectoid position: Al about 5 percent. The zinc alloy coating may further have a wetting agent such as lanthanum or cerium in an amount less than 0.1 percent of the zinc alloy. The remainder of the coating is zinc and unavoidable impurities.

Another preferable composition contains about 10% aluminum. This increased amount of aluminum provides a better corrosion protection then the eutectoid composition with about 5% of aluminum.

Other elements such as silicon (Si) and magnesium (Mg) may be added to the zinc aluminum coating. With a view to optimizing the corrosion resistance, a particular good alloy comprises 2% to 10% aluminum and 0.2% to 3.0% magnesium, the remainder being zinc.

An example is 5% Al, 0.5% Mg and the rest being Zn.

A zinc or zinc alloy coating is preferably applied to the steel wire by means of a hot dip operation.

A wire drawing operation can be applied both before, after or before and after the hot dip operation.

The weight of zinc or zinc alloy on the steel wire is preferably above 100 g/m$^2$, e.g. above 110 g/m$^2$, in order to guarantee the required corrosion resistance.

The diameter of the steel wire may range from 1.5 mm to 4.0 mm, e.g. from 2.0 mm to 3.5 mm. The height of the knotted wire fence may range from 1 meter on to about 2 meter. Examples of fence heights are 122 cm (48 inch), 152 cm (60 inch) and 183 cm (72 inch).

The width of an opening or mesh may be about 5 cm (2 inch) in horizontal direction and 10 cm (4 inch) in vertical direction.

As mentioned, in some embodiments the horizontal steel wires may have a breaking load that is higher than the breaking load of the vertical steel wires, since the horizontal steel wires are under tension, once installed. For example, the horizontal steel wires may have a diameter of 2.5 mm while the vertical steel wires may have a diameter of 2.0 mm.

In other preferable embodiments the steel wires that are used to make the knot are more ductile than the horizontal steel wires and the vertical steel wires. An increased degree of ductility may be expressed by a higher elongation at break or by a higher number of bends around a radius of curvature before fracture occurs.

Removing some of the vertical wires makes available sufficient length 38 in the horizontal wires 32, 32', 32" to connect the horizontal wires 32, 32', 32" to the post 10. A table or graph may be provided to indicate the number of vertical wires to be removed based upon the total length to be tensioned.

The horizontal wire ends are inserted through the holes 18 of post 10. Once inserted through the holes 18, a wire tensioner 39 is attached to each horizontal wire. FIG. 3 illustrates such a wire tensioner 39 attached to some, but not all, horizontal wires 32.

Figure 4:
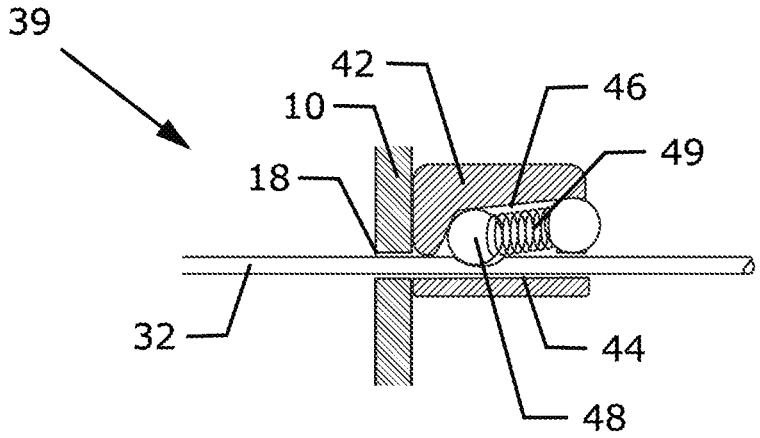
FIG. 4 illustrates the working principle of a wire tensioner.

An example of a tensioner 39 is illustrated in FIG. 4. Such a tensioner 39 may have a body 42 with a first passage 44 through which a horizontal wire 32 passes. There is also a second intersecting passage 46 that carries a ball 48 or disc which is spring-biased 49 towards the intersection and rolls in the second passage 46 in a position locking the horizontal wire 32 under tension. Since the horizontal wires 32 are preferably steel wires, the tensioner 39 is preferably made of metal, most preferably of steel. This metal or steel of the tensioner 39, particularly the metal or steel of the inner side of the passage 44 and of the ball 48 are in direct contact with the horizontal steel wire 32.

In a next step each horizontal wire 32, 32', 32" is tensioned so that the wire fence 30 has a regular and planar appearance without undulations. This esthetical appearance may be reached without providing an undulation or crimp in the horizontal wires 32, 32', 32".

Finally, a cover plate 40 may be attached to the post thereby hiding the various horizontal wire ends and the tensioners 39. A cap (not shown) may be provided on top of the post 10 and cover plate 40.

The following alternative installation method may be provided.

All poles are installed into the ground, at least one pole at the start and one pole at the end. Guidelines or tables are provided on how many poles are required in between.

Optionally, a table is provided which indicates the required length of the fence as a function of the area to be covered (taking into account elastic behavior during tensioning).

At both ends of the wire, the following steps are performed:

a) At least one of the stay wires is removed from the line wire. This exposes a free length of line wire, at least the length of the grid or mesh opening.

b) The free length of the line wire is folded over the knot of the first stay wire. It is folded at least 180° but preferably more.

c) The mesh is connected to the first pole.

d) At this first end of the fence, a piece of rod with the length at least equal to the height of the fence (further called a tensioning bar) is woven into the fence: in between the first (fixed) and the second stay wire and alternating at the front side and at the back side of the horizontal line wires.

e) A horizontal line wire is connected to the first pole. This may be done either by winding a horizontal wire around pole or by fixing this horizontal wire to a clip that is connected to the pole.

f) Thereafter, the fence may be tensioned at a first end.

The same procedure may be repeated at the other end of the fence. A tensioning bar is connected to the second end of the fence.

At a distance of around two meter from the end of the mesh, a tensioning device is connected to the mesh.

The tensioning device can be two bars (preferably square, the length at least equal to the height of the fence) that are positioned on either side of the fence and pushed together, thereby squeezing the line wire in between.

The fence can then be tensioned by connecting any type of pulling system to the tensioning device and the end pole (or a temporary pole installed only for the purpose of tensioning).

The mesh can be connected to the end pole by connecting the tensioning bar to the pole as before.

The following digital tool may be provided to facilitate installation.

A customer experience platform is provided on which:

a) The consumer can design a fence by selecting the fence size, wire diameter, pole design and color.

b) The consumer can visualize and measure the length of a fence by the use of a maps system (e.g. Google Maps).

c) The consumer can select an installer from the list of approved installers or select the self-installation option.

The self-installation option makes any necessary tools available either for purchase or for renting.

Once all input has been given, all materials required to install the selected fence are shipped to the consumer (in case of self-installation) or to the selected installer.

LIST OF REFERENCE NUMBERS

10 post
12 bottom plate
14 upper part of post
16 lower part of post
18 hole
19 reinforcing brace for post
20 reinforcing brace for bottom plate
30 wire fence
32 horizontal wire
32' upper horizontal wire
32" bottom horizontal wire
36 knot
37 wrapping of vertical wire
38 length to attach horizontal wires to post
39 tensioner
40 cover plate
42 body of tensioner
44 first passage in tensioner
46 second passage in tensioner
48 ball
49 spring

The invention claimed is:

1. A method of installing a wire fence to a post,
said wire fence comprising horizontal and vertical wires,
said horizontal wires having horizontal wire ends,
said method comprising the following steps:
a) providing horizontal wires;
b) providing vertical wires;
c) connecting the vertical wires to the horizontal wires to form a wire fence;
d) providing a post;
e) providing holes in said post, one hole for each horizontal wire;
f) driving said post into the ground;
g) providing sufficient length at said horizontal wire ends to allow termination and tensioning of said horizontal wires;
h) inserting said horizontal wire ends through said holes;
i) attaching wire tensioning devices to some of said horizontal wire ends;
j) stretching said horizontal wires by means of said tensioning devices;
k) keeping said tensioning devices on said horizontal wire ends; and
l) placing a cover plate to said post to cover said tensioning devices and said horizontal wire ends.

2. The method according to claim 1,
wherein in step i) wire tensioning devices are attached to all of said horizontal wire ends.

3. The method according to claim 1,
wherein step c) of connecting the vertical wires to the horizontal wires is done by a piece of wire that forms a knot.

4. The method according to claim 1,
wherein step g) of providing sufficient length is done by removing one or more vertical wires.

5. The method of according to claim 1,
wherein a bottom plate is attached to said post in step d) so that said bottom plate divides said post into an upper part intended to stay above the ground and a lower part intended to be driven into the ground.

6. The method according to claim 5,
wherein said bottom plate is reinforced.

7. The method according to claim 6,
wherein step f) of driving said post into the ground is done by exercising force on said bottom plate.

8. The method according to claim 1,
wherein each of said horizontal wires comprises a first breaking load and each of said vertical wires comprises a second breaking load, and
wherein the first breaking load is higher than the second breaking load.

* * * * *